US010075790B2

(12) United States Patent
Hernandez et al.

(10) Patent No.: US 10,075,790 B2
(45) Date of Patent: Sep. 11, 2018

(54) DUAL COMMUNICATIONS HEADSET CONTROLLER

(71) Applicant: Tactical Command Industries, Inc., Brentwood, CA (US)

(72) Inventors: Pablo Hernandez, Oakley, CA (US); Timothy K. McNamara, New Palestine, IN (US)

(73) Assignee: Safariland, LLC, Jacksonville, FL (US)

( * ) Notice: Subject to any disclaimer, the term of this patent is extended or adjusted under 35 U.S.C. 154(b) by 0 days.

(21) Appl. No.: 14/995,360

(22) Filed: Jan. 14, 2016

(65) Prior Publication Data

US 2016/0212537 A1 Jul. 21, 2016

Related U.S. Application Data

(60) Provisional application No. 62/104,166, filed on Jan. 16, 2015.

(51) Int. Cl.
*H04R 3/12* (2006.01)
*H04R 1/10* (2006.01)

(52) U.S. Cl.
CPC ..... *H04R 3/12* (2013.01); *H04R 1/1041* (2013.01); *H04R 2201/107* (2013.01)

(58) Field of Classification Search
CPC ... H04R 3/12; H04R 1/1041; H04R 2201/107
USPC ..... 381/81, 17, 58, 309, 310
See application file for complete search history.

(56) References Cited

U.S. PATENT DOCUMENTS

| | | | | |
|---|---|---|---|---|
| 7,251,332 | B2 * | 7/2007 | Eves | H01Q 1/273 381/11 |
| 2003/0063761 | A1 * | 4/2003 | Hlibowicki | H04R 3/14 381/111 |
| 2003/0223602 | A1 | 12/2003 | Eichler et al. | |
| 2004/0076301 | A1 | 4/2004 | Algazi et al. | |
| 2008/0199029 | A1 | 8/2008 | Loeppert | |
| 2010/0278349 | A1 | 11/2010 | Yamkovoy et al. | |
| 2012/0275603 | A1 * | 11/2012 | Wedge | H04R 3/00 381/2 |

(Continued)

FOREIGN PATENT DOCUMENTS

WO 2007005119 A2 1/2007

OTHER PUBLICATIONS

PCT Appln. No. PCT/US2016/013359; PCT Search Report and Written Opinion dated Jun 2, 2016.

*Primary Examiner* — Melur Ramakrishnaiah
(74) *Attorney, Agent, or Firm* — Kane Kessler, P.C.; Paul E. Szabo

(57) ABSTRACT

A headset controller for controlling two incoming radio signals for a headset that includes a left earcup and a right earcup. The controller includes a first radio signal input connection configured for receiving a first radio signal from a first radio, and a second radio signal input connection configured for receiving a second radio signal from a second radio different from the first radio. The controller also includes an electrical sensing and switching mechanism that is operative, when both channels have incoming signals, to send each signal separately to a respective earcup. The electrical sensing and switching mechanism is operative, when only one of the two channels has an incoming signal, to send that one signal to both earcups.

4 Claims, 2 Drawing Sheets

(56) References Cited

U.S. PATENT DOCUMENTS

2013/0281034 A1* 10/2013 Mazzeo ..... H04W 4/10
455/90.2
2014/0220918 A1* 8/2014 Sherwood ..... H03J 1/0083
455/161.1

* cited by examiner

DUAL COMMUNICATIONS HEADSET CONTROLLER

BACKGROUND OF THE INVENTION

Prior Art

This invention relates to a controller for a dual communications headset. Such a headset is commonly worn by a soldier, and enables the wearer to listen to incoming signals from one or both of two different radios. In these headsets, when both channels have incoming signals, one signal (Radio 1) is sent, to the left earcup of the headset and the other signal (Radio 2) is sent to the right earcup of the headset. When only one channel has an incoming signal, only that one earcup is active and generates sound for the wearer.

SUMMARY OF THE INVENTION

The controller of the present invention includes an electrical sensing and switching mechanism that provides a different mode of operation. As with the prior art product, when both channels have incoming signals, one signal (Radio 1) is sent to the left earcup and the other signal (Radio 2) is sent to the right earcup. However, and in accordance with the present invention, if only one of the two channels has an incoming signal, the controller automatically senses that fact, and automatically switches that one signal over to both earcups of the headset. As a result, when only one channel has an incoming signal, that signal generates sound for the wearer through both earcups.

DETAILED DESCRIPTION

Figure 1:
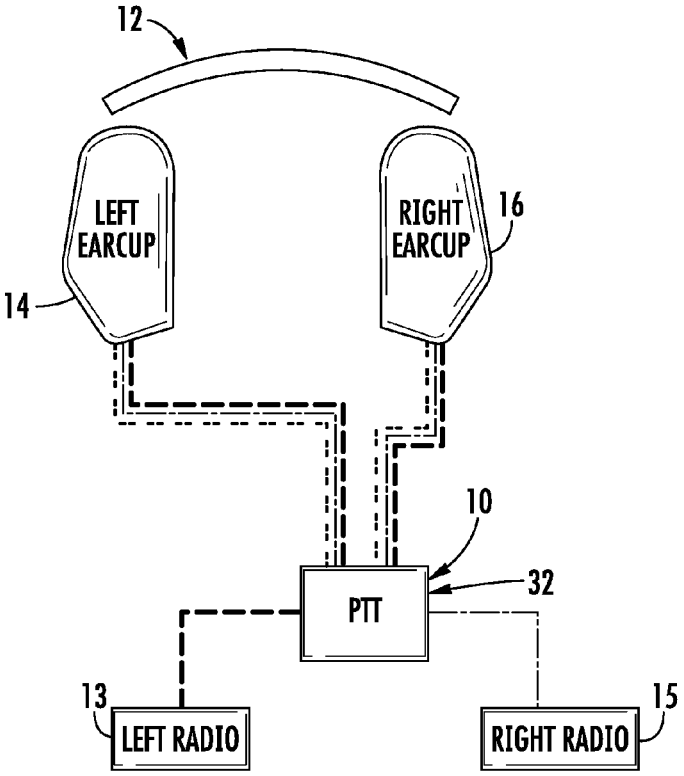
FIG. 1 is a pictorial drawing illustrating the several flow paths that are available for the radio signals between the controller and the headset.

The present invention relates to a controller 10 for a dual communications headset, for example of the type worn by soldiers, that enables the wearer to listen to incoming signals from either one or two different radios. The invention is applicable to controllers of various different configurations. As representative of the invention, the drawings illustrate a controller 10 that is a first embodiment of the invention.

The controller 10 (FIG. 1) is shown as being configured for electrical connection with a headset 12, a left radio 13, and a right radio 15. The headset 12 has a left earcup 14 for providing sound to the wearer's left ear and a right earcup 16 for providing sound to the wearer's right ear.

Figure 2:
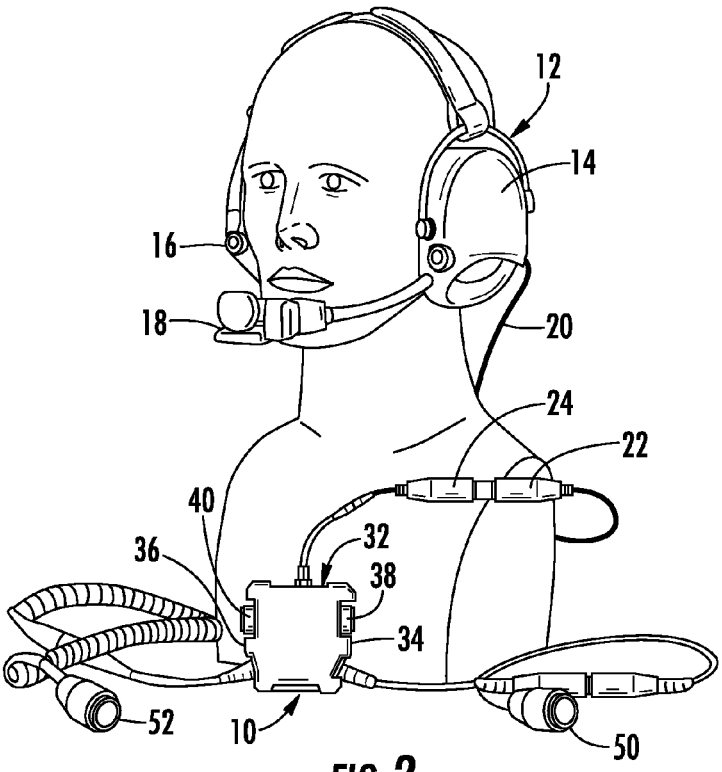
FIG. 2 is a pictorial view of the controller connected with two radios and a headset.

The headset 12 also carries a microphone 18 (FIG. 2). A cable 20 extends from the headset 12 and terminates in a six-pin headset connector 22. The headset connector 22 is mechanically and electrically correctable with a six-pin connector 24 extending from the controller 10. The output of the controller 10 is directed through the cable 20 to the left and right earcups 14 and 16 of the headset 12, so that the wearer of the headset can listen to the radio signals that are incoming to the controller 10 from the left and right radios 13 and 15, respectively.

The controller 10 is embodied in electrical circuitry 30 (FIG. 3) that is preferably located in the wearer's PTT (push to talk) unit 32. As is typical with dual communication headsets, the PTT unit 32 (FIG. 2) is designed with a left side indicated generally at 34 and a right side indicated generally at 36. The PTT unit 32 includes left and right PTT buttons 38 and 40, respectively. Each button 38 or 40 controls a normally closed contact and a normally open contact. When one of the buttons 38 or 40 is pushed, its normally closed contact opens so that the output of the microphone 18 is directed to the selected radio 13 or 15, and its normally open contact closes, to prevent the microphone output from being send through the other radio. Thus, when the wearer needs to talk on the right radio 15, the wearer pushes the right talk button 40. This action closes (enables) the talk circuitry on the right radio 15 and opens (disables) the talk circuitry on the left radio 13. In a similar manner, when the wearer needs to talk on the left radio 13, the wearer pushes the left talk button 38. This action closes (enables) the talk circuitry on the left radio 13 and opens (disables) the talk circuitry on the right radio 15.

Figure 3:
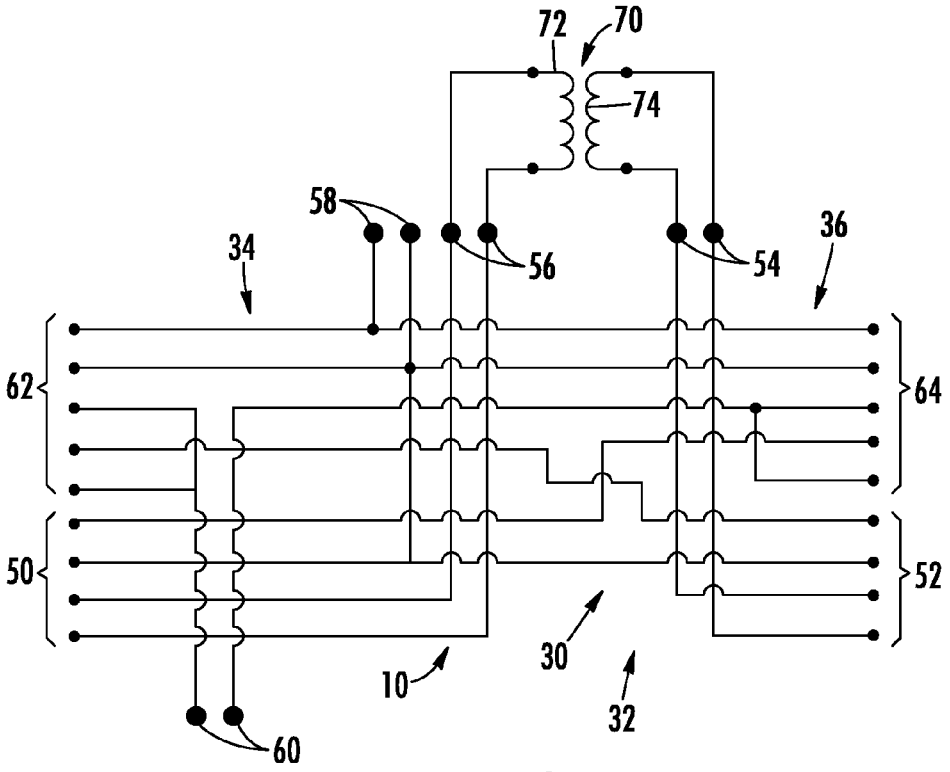
FIG. 3 is an electrical circuitry diagram of portions of the controller.

FIG. 3 is a simplified electrical schematic diagram of parts of the PTT unit 32 including the controller 10. The four terminals at the bottom left of the diagram, indicated jointly by the reference numeral 50, are the electrical connection to the left radio 13. The four terminals at the bottom right of the diagram, indicated jointly by the reference numeral 52, are the electrical connection to the right radio 15.

The two terminals at the top right of the diagram, indicated jointly by the reference numeral 54, are the electrical connection to the right earcup 16. The two inner terminals near the top left of the diagram, indicated jointly by the reference numeral 56, are the electrical connection to the left earcup 14.

The two outer terminals at the top left of the diagram, indicated jointly by the reference numeral 58, are the electrical connection to the microphone 18. The six terminals 54, 58, and 58, as a group, are electrically connected to the headset via the cable 20.

The two terminals at the bottom center of the diagram, indicated jointly by the reference numeral 60, provide an electrical connection for an auxiliary unit (not shown) such as a smartphone. Also indicated in FIG. 2 are connections 62 to the left radio talk button 38, and connections 64 to the right radio talk button 40.

In accordance with the present invention, the left and right sides 34 and 36 of the circuitry 30 are bridged with a 1:1 ratio transformer 70, enabling full-time delivery of one signal in both ears unless audio signals from both sides of the circuitry 30 are received simultaneously. Specifically, the transformer 70 is connected across the left earcup terminals 56 and the right earcup terminals 54. The transformer 70 includes a left coil 72 and a right coil 74. When an audio signal is present on only the left side 34, an electrical current flows through the left coil 72 of the transformer 70 and generates a magnetic flux that causes a corresponding current to flow in the right coil 74 of the transformer. This current is an equivalent of the current in the left coil 72 of the transformer 70, and as a result a corresponding audio signal is provided to the right earcup 16. The operation is reversed when a signal is present in only the right side 36. One suitable transformer 70 is available from Pico Electronics, Inc., of Pelham N.Y., in their "Ultra-Miniature Transformers series of F Series Plug-in and G Series Insulated Leads transformers.

The operation of the controller 10 can also be illustrated with reference to FIG. 1. The controller 10 is electrically connected with both the left radio 13 and the right radio 15. When both radios 13 and 15 are receiving incoming signals, the controller 10 senses that fact. One of the two signals (from the left radio 13) is sent to only the left earcup 14, as indicated by the dark dashed line extending from the left radio to the controller and thence to the left earcup. At the same time, the other signal, from the right radio 15, is sent to only the right earcup 16, as indicate by the light dot-dash line extending from right radio to the controller and thence to the right earcup.

However, if only the left radio 13 has an incoming signal, then the controller 10 automatically senses that fact, and automatically switches that signal over to both earcups 14 and 16 of the headset 12, as indicated by the two dark dashed lines extending from the controller to the two earcups. In a similar manner, if only the right radio 15 has an incoming signal, then the controller 10 automatically senses that fact, and automatically switches that signal over to both earcups 14 and 16 of the headset 12, as indicated by the two light dot-dash lines extending from the controller to the two both earcups.

As a result, when only one channel of the two possible radio channels has an incoming signal, that signal generates sound for the wearer through both earcups 14 and 16. This has significant advantages. First, for all users it provides enhanced clarity of the sound being heard, because the sound is transmitted through both earcups 14 and 16 and is heard by both ears. Second, if the wearer's hearing is not as good in one ear as in the other, the signal for that one earcup can (when coming in alone) be heard through both earcups 14 and 16—thus making it easier for the wearer to hear clearly. Third, providing sound always through both earcups 14 and 16 (whether from one or two incoming signals) decreases the disorienting effect of hearing with only one ear. Finally, the controller 10 enables use of the headset 12 as a stereo headset for a smartphone.

Although there are other ways to accomplish the invention, the use of the transformer 70 provides numerous advantages. First, these devices are very small, and thus fit into the limited space available in the small PTT unit. Second, they draw no extra power, which is important for field use. Third, they do not require sophisticated digital circuitry, which can be complex to design, more expensive to build, and more power intensive.

From the foregoing description of the invention, those skilled in the art will perceive improvements, changes and modifications. For example, alternative electrical circuitry can be used so long as it provides the same result. Such improvements, changes and modifications within the skill of the art are intended to be covered by the appended claims.

The invention claimed is:

1. A headset controller for controlling multiple incoming radio signals, the controller being configured to electrically connect with a headset worn by a wearer that includes a left earcup for providing sound to the wearer's left ear and a right earcup for providing sound to the wearer's right ear, the controller including:

a first radio signal input connection configured for receiving a first radio signal from a first radio;

a second radio signal input connection configured for receiving a second radio signal from a second radio different from the first radio; and an electrical switching mechanism;

the electrical switching mechanism comprising electrical circuitry operative to sense the presence of a first radio signal at the first radio signal input connection;

the electrical switching mechanism comprising electrical circuitry operative to sense the presence of a second radio signal at the second radio signal input connection;

the electrical switching mechanism comprising electrical circuitry operative, when a first radio signal is present and a second radio signal is not present, to direct the first radio signal to both the left earcup and the right earcup;

the electrical switching mechanism comprising electrical circuitry operative, when a second radio signal is present and a first radio signal is not present, to direct the second radio signal to both the left earcup and the right earcup; and the electrical switching mechanism comprising electrical circuitry operative, when both a first radio signal and a second radio signal are present, to direct the first radio signal to only the left earcup and the second radio signal to only the right earcup;

wherein the electrical circuitry includes a first side that receives the first radio signal and that includes a left earcup terminal, and a second side that receives the second radio signal and that includes a right earcup terminal;

wherein the left and right sides of the circuitry are bridged with a ratio transformer that is connected across the left earcup terminal and the right earcup terminal;

wherein the transformer includes a left coil and a right coil, the left coil being part of the first side of the electrical circuitry and the second coil being part of the second side of the electrical circuitry; and wherein when an audio signal is present on only the left side of the electrical circuitry an electrical current flows through the left coil of the transformer and generates a magnetic flux that causes a corresponding current to flow in the right coil of the transformer, the corresponding current being an equivalent of the current in the left coil of the transformer, wherein a corresponding audio signal is provided to the right earcup.

2. A headset controller as set forth in claim 1 wherein the electrical switching mechanism is included in a push to talk unit.

3. A headset controller as set forth in claim 1 that does not include a power supply and wherein the transformer is a 1:1 ratio transformer.

4. A headset controller for controlling two incoming radio signals, the controller being configured to electrically connect with a headset worn by a wearer that includes a left earcup and a right earcup, the controller including:

a first radio signal input connection configured for receiving a first radio signal from a first radio, and a second radio signal input connection configured for receiving a second radio signal from a second radio different from the first radio; and an electrical sensing and switching mechanism that is operative, when both channels have incoming signals, to send each signal separately to a respective earcup, the electrical switching mechanism being operative, when only one of the two channels has an incoming signal, to send that one signal to both earcups;

wherein the electrical switching mechanism includes a 1:1 ratio transformer connected across left and right output terminals of the electrical sensing and switching mechanism; and wherein the controller does not include a power supply.

* * * * *